US010087615B1

(12) United States Patent
Christie et al.

(10) Patent No.: US 10,087,615 B1
(45) Date of Patent: Oct. 2, 2018

(54) CONNECTION APPARATUS

(71) Applicant: CHRISTIE LITES ENTERPRISES CANADA INC., Toronto, Ontario (CA)

(72) Inventors: Huntly Christie, Orlando, FL (US); Percy Adler, Consecon (CA); Michael Grove, Orlando, FL (US)

(73) Assignee: CHRISTIE LITES ENTERPRISES CANADA INC., Toronto (CA)

( * ) Notice: Subject to any disclaimer, the term of this patent is extended or adjusted under 35 U.S.C. 154(b) by 0 days.

(21) Appl. No.: 15/827,736

(22) Filed: Nov. 30, 2017

(51) Int. Cl.
*E04C 3/04* (2006.01)
*E04B 1/19* (2006.01)
*E04H 3/24* (2006.01)

(52) U.S. Cl.
CPC ..... *E04B 1/1903* (2013.01); *E04C 3/04* (2013.01); *E04B 2001/196* (2013.01); *E04B 2001/1927* (2013.01); *E04C 2003/0486* (2013.01); *E04H 3/24* (2013.01)

(58) Field of Classification Search
CPC ..... E04B 1/1903; E04B 2001/196; E04B 2001/1927; E04C 3/04; F16B 43/02
See application file for complete search history.

(56) References Cited

U.S. PATENT DOCUMENTS 5,498,093 A * 3/1996 Imai ..... E04B 1/1906 403/169
5,545,230 A * 8/1996 Kissinger ..... A61F 2/76 403/12
6,032,430 A * 3/2000 Soukup ..... E04B 1/585 403/170
9,957,709 B2 * 5/2018 Kempf ..... E04B 1/344
2015/0107181 A1 * 4/2015 Larsen ..... E04B 1/1903 52/655.1
2015/0233496 A1 * 8/2015 Chouinard ..... E04C 3/04 248/62
2016/0273210 A1 * 9/2016 Tello ..... E04B 1/2403
2016/0377109 A1 * 12/2016 Oka ..... F16B 39/24 411/371.2
2017/0218988 A1 * 8/2017 Piccolo ..... F16B 5/025
2017/0342702 A1 * 11/2017 Kempf ..... E04C 3/04
2018/0155918 A1 * 6/2018 De Almeida Borges ..... E04B 1/19

* cited by examiner

*Primary Examiner* — Paola Agudelo
(74) *Attorney, Agent, or Firm* — DLA Piper LLP US

(57) ABSTRACT

A connection apparatus may be used to connect truss sections or other objects. A connection segment is mounted on each truss to be connected. Each of a first and second connection segment has an opening, in alignment with each other to receive a fastener. The opening of the first connection segment allows the fastener to pivot. The second connection segment has a side opening which allows the fastener to pivot inside and outside the body of the second connection segment. The fastener has a threaded end and a locking end. The locking end may be secured against an outer surface of the second connection segment. In the locked position the locking end of the fastener engages the outer surface of one the second connection segment and the fastener is prevented from rotational or axial movement. The connection segments are thus fixed relative to each other as are the truss sections on which the connection sections may be mounted.

19 Claims, 23 Drawing Sheets

CONNECTION APPARATUS

FIELD OF THE INVENTION

The present invention generally relates to an apparatus and method for connecting two objects. For example, the apparatus and method may be used to connect objects such as truss sections to provide a single truss structure. Truss structures may be used to support displays, lighting systems, or sound systems for concerts, festivals, trade shows or in theatres. Each time they are used, truss structures are assembled from individual truss sections. Once a concert, festival, or trade show has concluded the truss structures are disassembled and the truss sections are transported to other venues or to storage facilities.

BACKGROUND OF THE INVENTION

Connection apparatus may be used in a variety of applications and industries. In one application, connection apparatus may be used to interconnect truss sections. Truss sections may be used in a variety of industries, including the entertainment industry, where they are used for the construction of truss structures for mounting lighting, cameras, displays, and speaker systems. Truss structures are commonly used in entertainment (and in particular concert) venues for this purpose.

Although some means are needed to secure lighting, sound, camera, and display equipment for concerts, not all entertainment venues are equipped with such means. Accordingly, in some cases truss sections are transported to the venue and a truss structure is assembled on site. Because renting of a venue is costly, it is desirable for truss structures to be assembled and disassembled quickly to minimize rental costs. Assembling such a truss structure can be large and complex job.

Truss structures are typically constructed by placing truss sections adjacent to one another and joining them together using connection apparatus. In order to form a single unitary whole, each truss section comprises means for connecting with other truss assemblies. For example, the connecting means may comprise a set of connection openings that may be aligned as between separate truss sections and through which connection hardware, such as pins or bolts, may be inserted to create firm connection points.

Truss sections are normally shipped out to venues from a central storage facility or possibly from a number of disparate storage facilities. Connection hardware must be present at the venue in order for the truss sections to be assembled.

Connection hardware and fasteners are quite small relative to the truss sections and as a result may be stored separately from the truss sections. Alternatively, the disassembler may choose to attach the connection hardware to individual truss sections for storage. However, there is no guarantee that the connection hardware is stored in a consistent manner such that truss sections that are delivered to a sit arrive with an appropriate amount of connection hardware. The lack of appropriate connection hardware may lead to delays and increase in the time required to assemble the truss structure.

BRIEF DESCRIPTION OF THE DRAWINGS

The following drawings illustrate examples of the components of the invention disclosed herein, and are for illustrative purposes only. Other embodiments that are substantially similar can use other components that have a different appearance.

DETAILED DESCRIPTION

Figure 1:
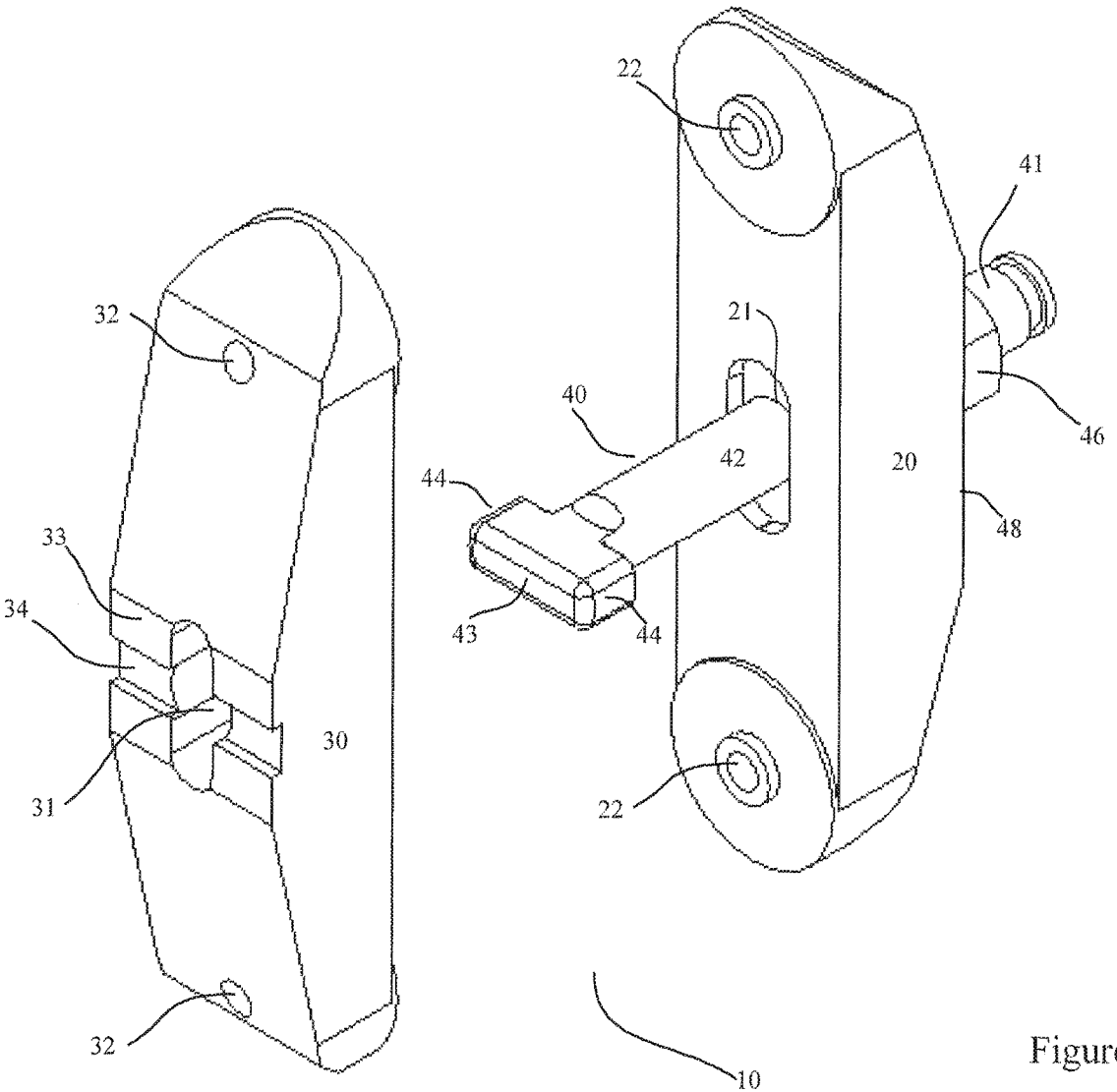
FIG. 1 is an isometric view of an embodiment of the connection apparatus depicting a first connection segment, a bolt with a T-shaped locking end and a second connection segment.

The present invention relates to a connection apparatus and method to allow efficient assembly of structures.

In an embodiment of the present invention, provided is a connection apparatus that has a first fastener a threaded end, a locking end opposite the threaded end, and a shaft between the locking end and the threaded end. Also provided is a second fastener adapted to receive the threaded end of the first fastener. Also provided is a first connection segment, the first connection segment has a first opening dimensioned to receive the threaded end and the shaft of the first fastener, the first opening is further adapted to allow the first fastener to pivot radially within the opening between a first position and a second position, whereby the first position is at an angle relative to the second position. Also provided is a second connection segment that has a body. The body has a side opening adapted to receive the shaft of the first fastener and allows the first fastener to pivot between the first position and the second position. The second connection segment also has an outer surface and a securing means on the outer surface which is adapted to fixably secure the locking end. When the first fastener extends through the first connection segment in the first position and the first and second connection segments are aligned and brought in proximity, the first fastener is aligned with the side opening of the second connection segment and outside the body of the second connection segment. When the first fastener is in the second position, the first fastener is inside the body of the second connection segment. When the second fastener is threaded and tightened to the threaded end of the first fastener and the locking end of the first fastener engages the outer surface of the body of the second connection segment, the first fastener is prevented from rotational or axial movement and the first and second connection segments are fixed relative to each other.

In another aspect, the first opening of the first connection segment has a rotatable joint, the rotatable joint comprising an opening for receiving the first fastener. When the first fastener is received through the opening of the rotatable joint, the first fastener is pivotable radially between the first position and the second position.

In a further aspect, the outer surface of the second connection segment has a securing means. When the second fastener is threaded and tightened to the threaded end of the first fastener and the locking end of the first fastener engages the securing means, the first fastener is prevented from rotational or axial movement and the first and second connection segments are fixed relative to each other.

In yet a further aspect, the securing means has a cavity corresponding in shape to the locking end of the first fastener.

In another aspect, the first fastener is a bolt and the second fastener is a nut.

In a further aspect, the threaded end of the first connection segment has a stopper. The stopper is wider than the inner diameter of the second fastener wherein the second fastener is prevented from removal from the first fastener.

In yet a further aspect, the stopper is a retainer ring and wherein the threaded end of the first fastener further comprises a channel for receiving the retainer ring.

In another aspect, the locking end of the first fastener is dimensioned such that it is prevented from passing through the first opening of the first connection segment.

In a further aspect, the connection apparatus interconnects a first object and a second object. The first connection segment is integral with the first object, and the second connection segment is integral with the second object.

In yet a further aspect, the first object is a first truss section and the second object is a second truss section.

In an embodiment of the present invention, a truss section is provided with at least one first connection segment for connection to a corresponding second connection segment on a second truss section. Each of the at least one first connection segments comprises an aperture dimensioned to receive therethrough the threaded end and the shaft of a first fastener. The aperture is adapted to allow the first fastener to pivot radially within the aperture between a first position and a second position. The first position is at an angle relative to the second position. The corresponding second connection segment comprises a body, comprising a side opening adapted to receive the shaft of the first fastener and further adapted to allow the first fastener to pivot between the first position and the second position, and an outer surface comprising a securing means adapted to fixably secure the locking end of the first fastener. When the first fastener extends through the aperture of the first connection segment in the first position and the first and second connection segments are aligned and brought in proximity, the first fastener is aligned with the side opening of the second connection segment and outside the body of the second connection segment. When the first fastener is in the second position inside the side opening, the first fastener is inside the body of the second connection segment. When the second fastener is tightened to the threaded end of the first fastener and the locking end of the first fastener engages the outer surface of the body of the second connection segment, the first fastener is prevented from rotational or axial movement and the first and second connection segments are fixed relative to each other.

In a further aspect, the aperture of the first connection segment of the truss section further comprises a rotatable joint which is rotatably fixed to the first connection segment, the rotatable joint comprising an aperture for receiving the first fastener. When the first fastener is received through the aperture of the rotatable joint, the first fastener is pivotable radially between the first position and the second position.

In yet a further aspect, the outer surface of the corresponding second connection segment comprises a securing means. When the second fastener is threaded and tightened to the threaded end of the first fastener and the locking end of the first fastener engages the securing means, the first fastener is prevented from rotational or axial movement and the first and second connection segments are fixed relative to each other.

In another aspect, the securing means comprises a cavity substantially corresponding in shape to the locking end of the first fastener.

In yet another aspect, the locking end of the first fastener is dimensioned such that it is prevented from passing through the aperture of the first connection segment.

While the present invention is described below primarily in relation truss sections and truss structures, it will be apparent to one of ordinary skill in the art that the present invention may be used to interconnect other objects and structures.

Reference will now be made to FIG. 1, which provides an isometric view of an embodiment of the connection apparatus 10 of the present invention.

The connection apparatus 10 comprises a first connection segment 20 and a second connection segment 30 and a bolt 40. The first connection segment 20 is adapted so that it can be securely attached to a first truss section (not shown in FIG. 1) and similarly, the second connection segment 30 is adapted so that it can be attached to a second truss section (not shown in FIG. 1). The first and second connection segments 20 and 30 can be attached to truss sections through a variety of means such as through welding, bolting, or fastening. Also, first and second connection segments 20 and 30 can be integral with a truss section. In the present embodiment, the first and second connection segments 20 and 30 are each equipped with two truss attachment holes 22 and 32, which correspond to holes in the truss (item 55 in FIG. 3) and are adapted to receive a bolt (not shown in FIG. 1) for attachment to the respective trusses.

The first connection segment 20 and second connection segment 30 can be securely connected together using bolt 40. Bolt 40 has a threaded end 41, a shaft 42 and a locking end 43. In the embodiment of FIG. 1 the locking end 43 is depicted as a T-shaped portion comprising a pair of protrusions 44 extending radially outwards from the shaft 42. The locking end 43 need not be configured as a T-shape and may be configured in other shapes suitable for locking an adjacent truss section. The locking end is provided with at least one protrusion from the shaft such that it can be received by and run through an opening in a second connection segment, for example borehole 31, while bolt 40 is in a first orientation. When the bolt 40 is rotated to a second orientation, it is "locked" in that it can no longer be received by or run through borehole 31. Moreover, the protrusions 44 are adapted to slot into a securing means 34 such that the bolt 40 may not be rotated when the locking end 43 is slotted into said securing means 34. Once slotted, the threaded nut 46 may be tightened to secure bolt 40 in place so as to not allow movement along the bolt's axis. The first and second connection segments (20 and 30) are thus locked in place relative to one another until the nut 46 is loosened.

The first connection segment 20 has an opening, for example borehole 21, dimensioned to receive the shaft 42 of the bolt 40. In the embodiment of FIG. 1, the borehole 21 is dimensioned such that the locking end 43 with protrusions 44 cannot pass though the borehole 21, thus maintaining one end of the bolt 40 in the borehole 21 as long as nut 46 is on the threaded end 41. The dimensions of borehole 21 can be more clearly seen in FIG. 2 and are further described below.

Also depicted in FIG. 1 is the second connection segment 30 which has a borehole 31 dimensioned to receive the shaft 42 of the bolt 40. The borehole 31 must also be dimensioned to allow the locking end 43 to pass through the borehole 31 in a first orientation but prevent it from passing through when the bolt 40 is rotated to another orientation. The second connection segment 30 has an outer surface 33 comprising a securing means 34. In the embodiment depicted in FIG. 1, securing means 34 is shaped as a linear slot and adapted to receive protrusions 44 of locking end 43 of bolt 40. Other shapes and dimensions may be provided as a means of securing the locking end 43 of bolt 40. Shaft 42 of bolt 40 must be of a sufficient length to, at least, allow the locking end 43 to pass through borehole 31 to the outer surface 33 for interaction with securing means 34 while allowing the threaded end 41 to protrude from borehole 21 on the outer surface 48 of the first connection segment 20 such that the nut 46 may be threaded but not tightened. When the locking end 43 of the bolt 40 passes through borehole 31, it can be rotated to an orientation where the pair of protrusions 44 prevent it from being able to pass back through the borehole 31. FIG. 1 shows bolt 40 rotated to an orientation whereby locking end 43 is not be able to be received by borehole 31.

In the embodiment of FIG. 1 the securing means 34 takes the form of a linear slot. The slot 34 corresponds with the shape of the pair of protrusions 44 such that the protrusions 44 fit into the slot 34 as the nut 46 is tightened onto the threaded end 46 of the bolt 40 and the bolt 40 is prevented from rotating to the first orientation by the edges of the slot 34 interacting with the protrusions 44 on the locking end 43. Thus, one the nut 46 is tightened and the protrusions 44 are engaged with the securing means 34, the bolt 40 remains in place to secure the truss sections. The slot 34 depicted in FIG. 1 is one embodiment of a securing means and embodiments of different shapes or sizes would perform similarly. Such other embodiments could include a pair of protrusions extending outwards from the outer surface 33 in a manner that allows them to secure the locking end 43 and prevent it from rotating.

In an alternate embodiment from that depicted in FIG. 1, the borehole in the first connection segment may be dimensioned to receive not only the shaft of the bolt but also the locking end. In this embodiment the bolt is not securely maintained within the opening in the first connection segment even when a nut is secured onto the threaded end. While this embodiment does not provide the advantage of maintaining the connection hardware within the first connection segment for ease of storage, it has the alternative advantage that the first connection segment and the second connection segment may be identical and thus used interchangeably. There would be fewer parts to manufacture and assembly may be simplified as there would be no need to align a first connection segment with a complementary second connection segment if they may both be used with either the locking end or the threaded end of a fastener.

In a further embodiment, the opening in either the first or second connection segment can be equipped with a gasket. During operation, when the bolt is disposed within the opening, the gasket abuts the surface of the shaft of the bolt. In one embodiment, the gasket may a rubber or plastic O-ring. The gasket operates to fill the space between the opening and the bolt, creating friction that resists rotational or axial movement of the bolt. This prevents the bolt fastener from sliding freely within the first opening and provides for more controlled operation and a more secure connection between truss sections.

Figure 2:
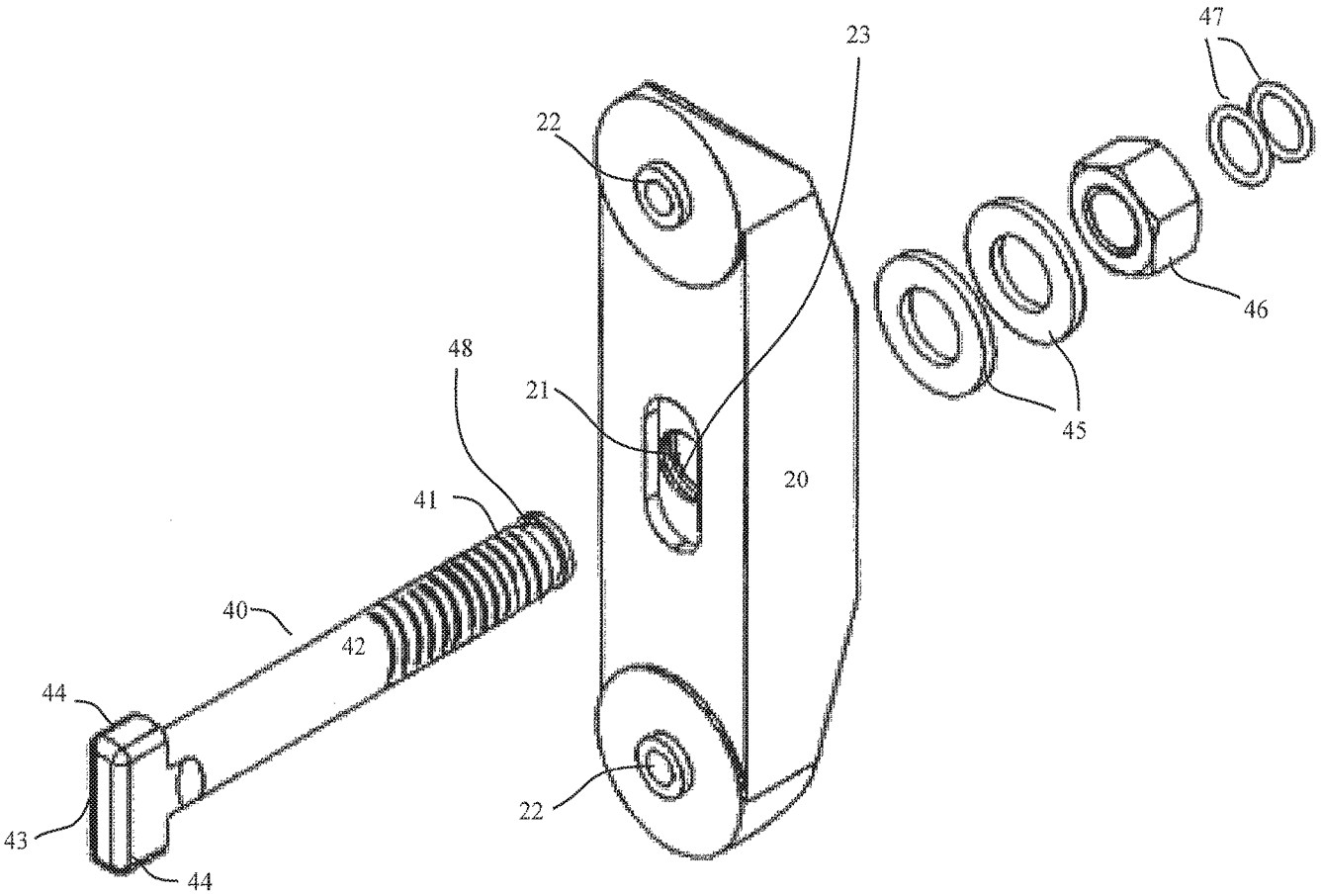
FIG. 2 is an exploded isometric view of the first connection segment shown in FIG. 1 including, a bolt with a T-shaped locking end, washers, a nut and two stoppers.
Figure 5:
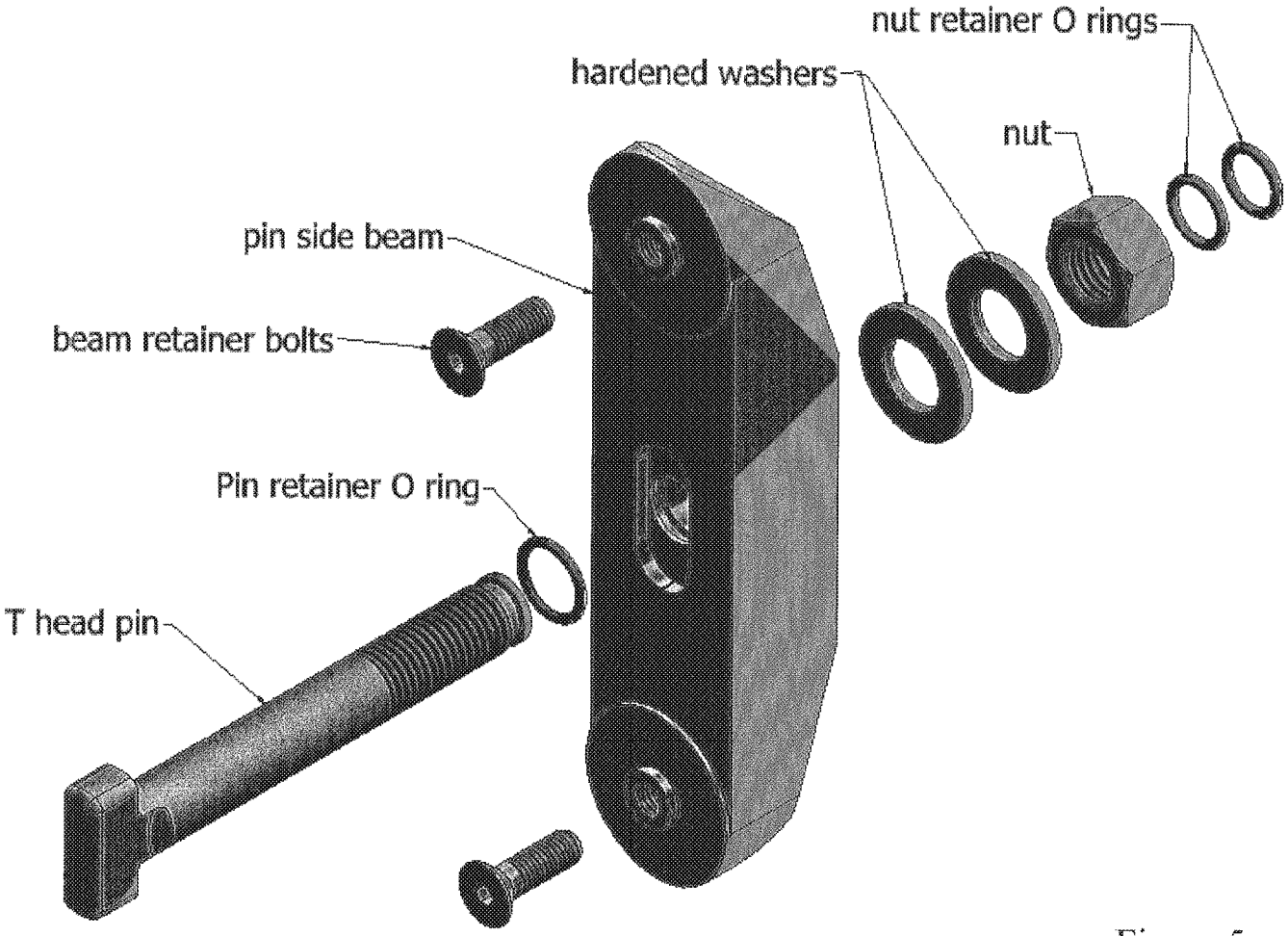
FIG. 5 is an isometric view of the embodiment illustrated in FIG. 2, further illustrating a pin retainer O-ring and beam retainer bolts.

FIG. 2 is an isometric exploded view providing more detail of the parts of the first connection segment 20. FIG. 2 shows bolt 40 prior to insertion into borehole 21. In this embodiment, the inside of borehole 21 comprises a ridge 23 for receiving a retaining means, such as an O-ring (which is shown in FIG. 5 and labelled "Pin retainer O ring"). This retaining means may be used to limit the amount that the bolt 40 slides within the borehole 21 and may help in reduce the likelihood of the bolt 40 inadvertently sliding out of the borehole 21 during assembly or disassembly of a truss structure, or while the various truss components are in transit. In this embodiment, the threaded end 42 will fit into borehole 21 but the protrusions 44 of locking end 43 prevent it from passing the whole way through. Once the threaded end 42 is received by borehole 21, the washers 45, nut 46 and stopper 47 can be secured to the threaded end 42 thus securing bolt 40 within borehole 21 such that bolt 40 can slide the length of shaft 41 within borehole 21 but is retained by the protrusions 44 at locking end 43 and nut 46 and stopper 47 at threaded end 42.

FIG. 2 shows bolt 40 rotated to an orientation whereby locking end 43 would be able to be received by borehole 31 as shown in FIG. 1.

The threaded end 41 of bolt 40 may comprise a stopper 47 (depicted in FIG. 2). Stopper 47 can prevent the bolt 40 from sliding out from the borehole 21, or the nut 46 from sliding off of the bolt 40 if unthreaded. The skilled person will appreciate that providing a stopper 47 provides at least the advantage of having the bolt 40 and all the connection hardware (nut, washers, etc.) securely captured by the first connection segment 20 such that it is less likely to get lost during assembly/disassembly, transit, or storage. In the embodiment depicted in FIG. 2, stopper 47 comprises a pair of O-rings which may be fitted on the threaded end 41 of bolt 40. In this embodiment, a retaining ridge 48 is provided for holding the O-rings 47 in place.

In certain circumstances, it may be preferable to allow bolt 40 to be removed from the first connection segment 20. This can be achieved by omitting the stopper 47 or providing a removable stopper 47 from the threaded end 41, thus allowing the nut 46 to be removed from the bolt, and the bolt 40 to be removed from the borehole 21. This can also be achieved through a different configuration of the borehole 21 in the first connection segment 20 whereby it is dimensioned to allow the locking end 43 to pass through the borehole 21 in one orientation but prevent locking end 46 from passing through when the bolt 40 is rotated to another orientation.

Figure 3:
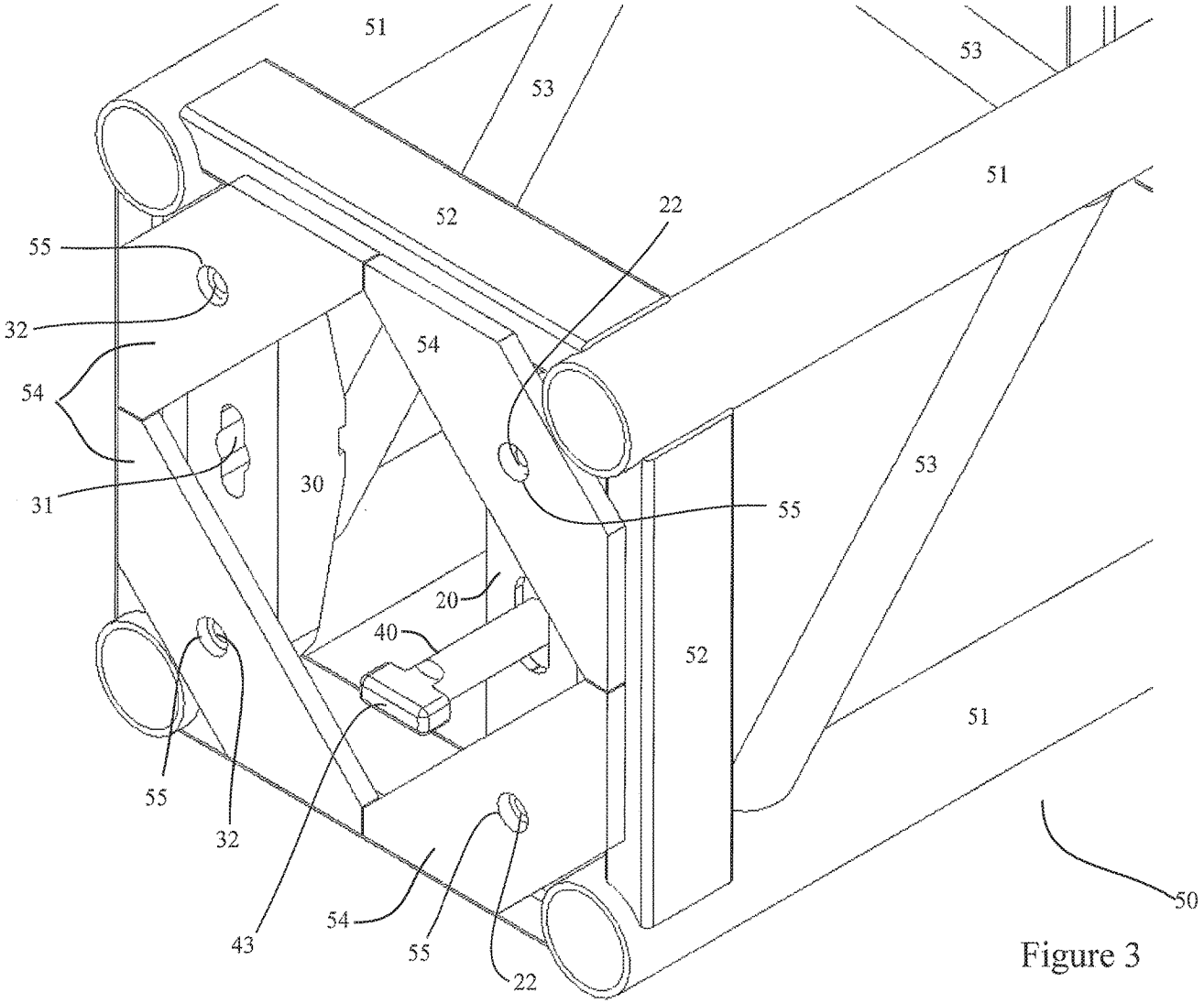
FIG. 3 is a schematic of an embodiment of a truss section depicting an end thereof with an attached first connection segment and a second connection segment.

FIG. 3 shows the end portion of truss section 50 with a first connection segment 20 and second connection segment 30 attached. Truss section 50 is made from four tubes 51 connected at each end by four end beams 52 to form a rectangular prism shape. The embodiment shown in FIG. 3 has diagonal braces 53 to provide additional rigidity. Truss sections come in many shapes and sizes. The truss connection apparatus of the present invention can be adapted to connect truss sections of various different shaped tubes and beams to achieve a truss structure of the desired shape and strength depending on the specific application.

As depicted in FIG. 3, the end of truss section 50 is equipped with four attachment plates 54. Each attachment plate 54 has a hole 55 to allow for first or second connection segments 20 and 30 to be attached to the truss section 50. Holes 55 are positioned and dimensioned to correspond with the respective truss attachment holes 22 and 32 of the first and second connection segments 20 and 30.

Figure 4:
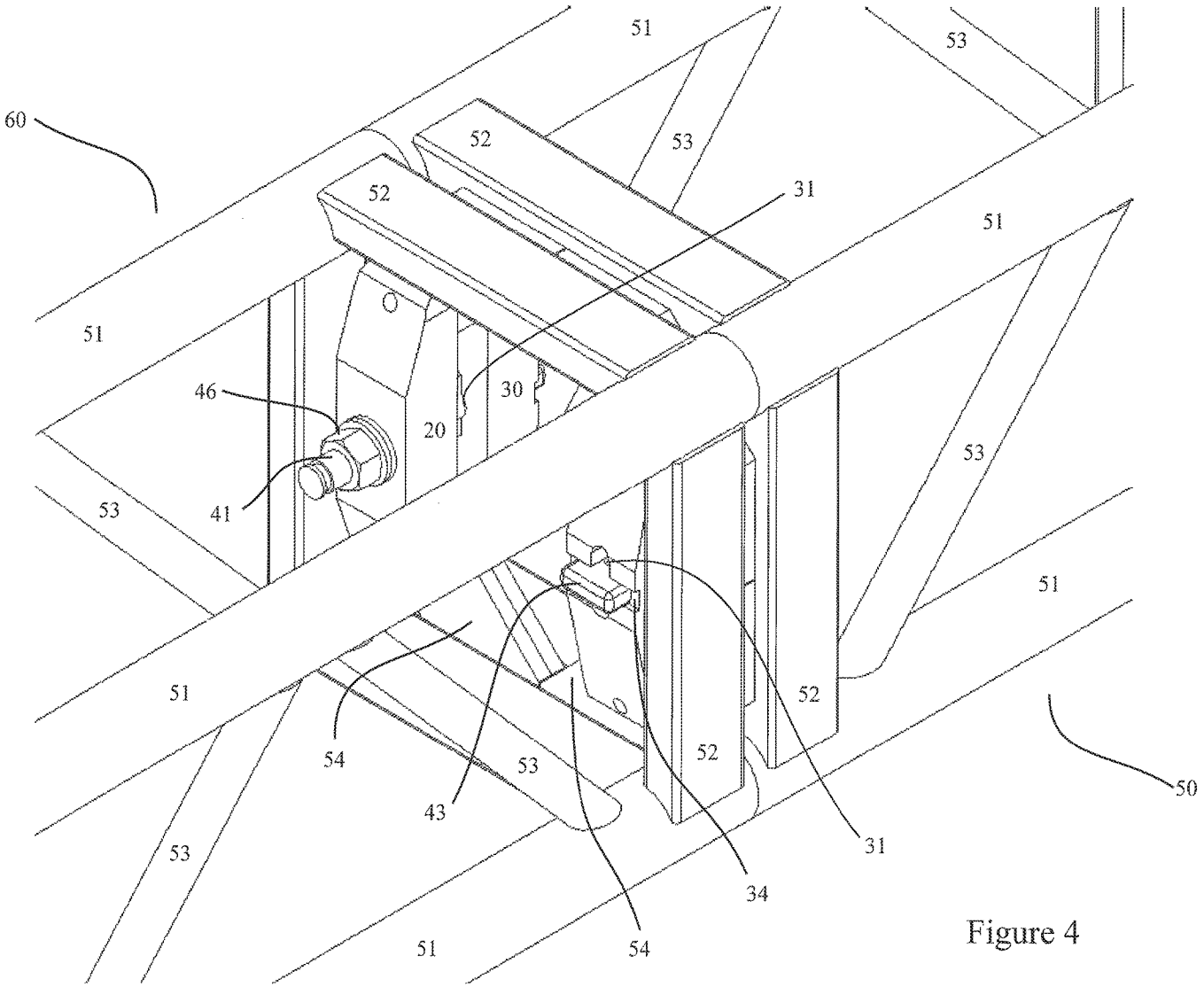
FIG. 4 is an isometric view of a truss structure depicting two truss sections, each having mounted a first connection segment and a second connection segment and further depicting the first and second connection sections of the truss connection apparatus in a locked position.

FIG. 4 depicts truss section 50 attached to a second truss section 60. Second truss section 60 has similar structure as truss section 50 but is equipped with first and second connection segments 20 and 30 in a way that correspond with the first and second connection segments 20 and 30 of truss section 50. In particular, the first connection segment 20 attached to truss section 50 should be aligned with the second connection segment 30 of truss section 60 such that the borehole 21 of first connection segment 20 aligns with the borehole 31 of second connection segment 30. The first connection segment 20 of truss section 60 is similarly aligned with its counterpart, second connection segment 30 of truss section 50. When assembling a truss structure, the ends of truss section 50 and second truss section 60 are brought together and abut against each other creating a close fit.

The truss sections depicted in FIGS. 3 and 4 are but one example and the ends of the truss sections can be adapted in many different ways to allow truss sections to abut or interlock.

To assemble a truss structure using the truss connection apparatus, the following method may be used. If a first connection segment 20 does not already have a bolt 40 passing through borehole 21, the threaded end 41 of bolt 40 is passed through borehole 21 of first connection segment 20. Washers 45, nut 46, and O-rings 47 are then secured to the end of bolt 40.

The first truss connection segment 20 is attached to a truss section 50 while a second connection segment 30 is secured to a second truss section 60. If the first and second connection segments (20 and 30) are integral with said truss sections, then this step is not needed. The ends of truss section 50 and second truss section 60 are then brought together such that the ends of the truss sections abut one another, and such that the borehole 21 of first connection segment 20 and borehole 31 of second connection segment 30 are aligned. The locking end 43 of bolt 40 of the first connection segment 20 can be inserted through the borehole 31 of the second connection segment 30. The bolt 40 must be inserted such that the protrusions 44 extend past the outer surface 33 of second connection segment 30, such that bolt 40 may be rotated. Bolt 40 can then be rotated to an orientation whereby it locking end 43 cannot be received by borehole 31. As nut 46 is tightened, bolt 40 is put into tension and the protrusions 44 of locking end 43 are drawn into slot 34 to prevent rotation of bolt 40 back to an orientation whereby it can be received by borehole 31. As nut 46 is tightened to an appropriate torque on each bolt 40, it creates a secure connection between the respective first and second connection segments 20 and 30, which in turn creates a secure connection between truss section 50 and second truss section 60.

Truss sections can be shaped and dimensioned differently. The number and placement of truss connection apparatus 10 required to create an appropriate connection will vary based on a number of factors including the type, shape dimension, material and weight of the truss section, the loads that will be applied to the truss, the interface between trusses being connected and the overall geometry of the truss structure being assembled.

FIGS. 6-19 illustrate a further embodiment of truss connection apparatus 70.

Figure 6:
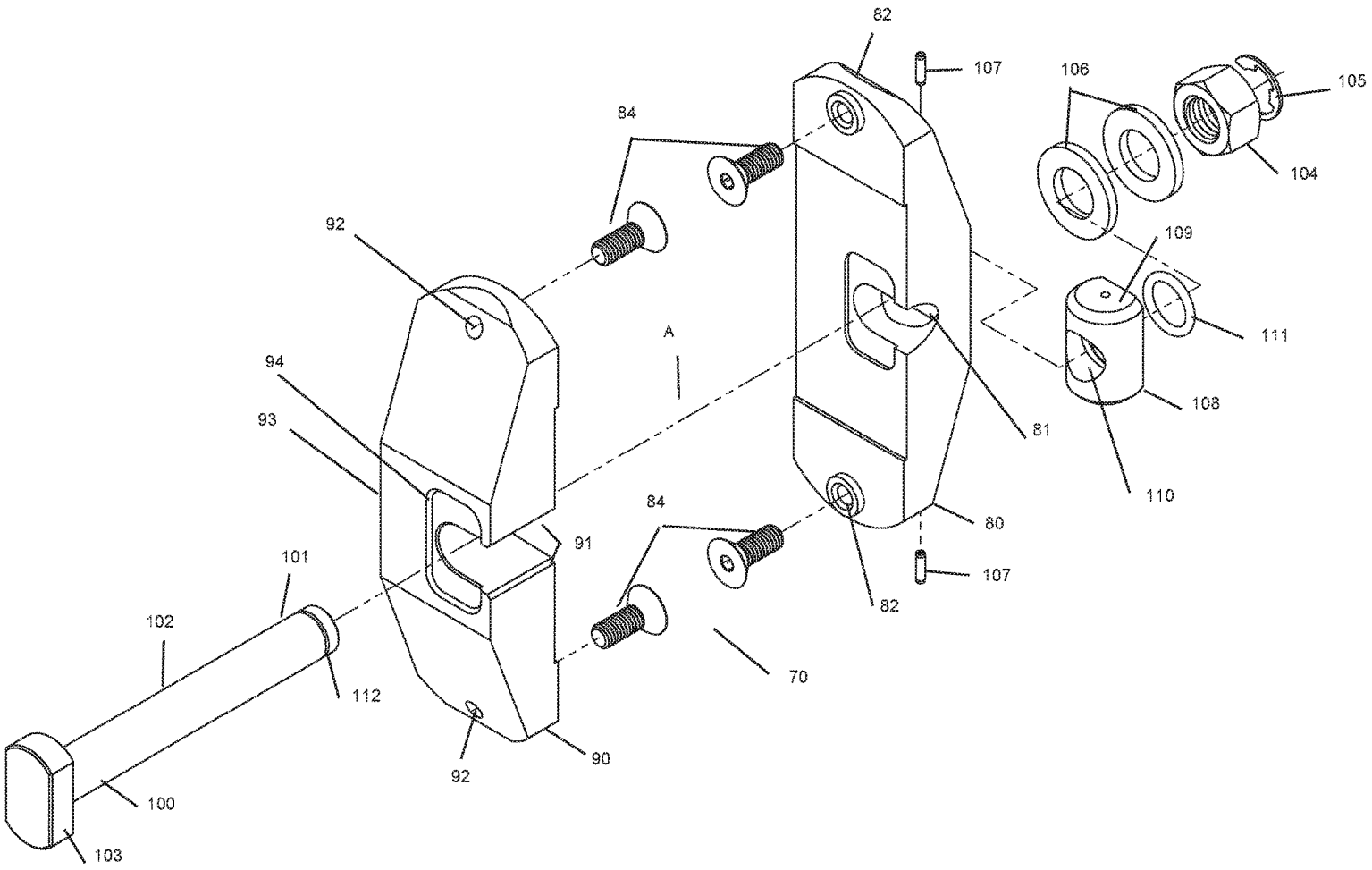
FIG. 6 is an exploded isometric view of a further embodiment of the connection apparatus.

FIG. 6 illustrates an exploded view of truss connection apparatus 70. The apparatus comprises a first truss connection segment 80 a second truss connection segment 90, and a first fastener 100. In this embodiment, the first fastener is a bolt. The first connection segment 80 is adapted so that it can be securely attached to a first truss section (not shown in FIG. 6) and similarly, the second connection segment 90 is adapted so that it can be attached to a second truss section (not shown in FIG. 6). The first and second connection segments 80 and 90 can be attached to truss sections through a variety of means such as through welding, bolting, or fastening. In this embodiment, the first and second connection segments 80 and 90 are each respectively equipped with two truss attachment holes 82 and 92, which correspond to holes in the truss (items 131 and 132 in FIGS. 13 and 14) and are adapted to receive a screw 84. Screws 84 secure the first and second connection segments 80 and 90 to respective trusses. Also, first and second connection segments 80 and 90 can be integral with a truss section (not depicted).

The first connection segment 80 and second connection segment 90 can be securely connected using bolt 100. Bolt 100 has a threaded end 101, a shaft 102 and a locking end 103. In the embodiment of FIG. 6 the locking end 103 is depicted as an oblong shaped flanged portion extending radially outwards from the shaft 102. The locking end 103 need not be configured as an oblong shaped flange and may be configured in other shapes suitable for locking an adjacent truss section.

The oblong shaped flange portion of the locking end 103 is adapted to slot into a securing means 94 such that the bolt 100 is restricted from movement when the locking end 103 is slotted into said securing means 94 to restrict the bolt from rotational movement. Once slotted, a threaded nut 106 may be tightened to secure bolt 100 in place so as to restrict movement along the bolt's axis (Axis A). The first and second connection segments (80 and 90) are thus locked in place relative to one another until the nut 106 is loosened.

The first connection segment 80 has a borehole 81, dimensioned to receive the threaded end of the shaft 102 of the bolt 100. In the embodiment of FIG. 6, the borehole 81 is dimensioned such that the locking end 103 cannot pass though the borehole 81.

The nut 104 is also dimensioned such that it cannot pass through the borehole 81. Thus, when the shaft 102 of bolt 100 is passed through the borehole 81, and the nut 106 is threaded to the threaded end 101 of the bolt 100, the bolt 100 is captured by the borehole 81 and may not be separated from the first connection segment 80 unless the nut 106 is taken off of the bolt 100. Those skilled in the art will appreciate that the use of a threaded shaft and a threaded nut is one means for securing a first fastener to a second fastener, and that other means may also be used.

Also depicted in FIG. 6 is the second connection segment 90 which has a side opening 91. The width of the side opening 91 is dimensioned to receive the shaft 102 of the bolt 100. The diameter of the locking end 103 is wider than the width of the side opening 91, thus preventing the locking end 103 from passing through the side opening 91 in a direction shown as Axis A in FIG. 6. The side opening 91 is preferably dimensioned to closely fit around the shaft 102. The second connection segment 90 has an outer surface 93 comprising a securing means 94. In the embodiment depicted in FIG. 6, securing means 94 is shaped as an oblong depression on the surface of the second connection segment 90 and is adapted to receive locking end 103 of bolt 100. Other shapes and dimensions may be provided as a means of securing the locking end 103 of bolt 100. Other means may also be provided to secure the locking end 103 to the first connection segment 90.

Shaft 102 is of a sufficient length to allow, when the apparatus is assembled, the locking end 103 to protrude from side opening 91 past the outer surface 93 for interaction with securing means 94 while allowing the threaded end 101 to protrude from borehole 81 on the outer edge of the first connection segment 80. When the shaft 102 is placed in the side opening 91 the locking end 103 prevents the bolt 100 from being able to pass back through the borehole side opening 91 in a direction perpendicular to the side opening 91.

In the embodiment of FIG. 6 the securing means 94 takes the form of an oblong depression in the outer surface 93 of the second connection segment 90. The oblong depression generally corresponds with the shape of the locking end 103 such that it fits into the oblong depression 94 as the nut 104 is tightened onto the threaded end 101 of the bolt 100. When the nut 104 is tightened, the bolt 40 is prevented from movement because of the edges of the oblong depression 94 interacting with the locking end 43. Thus, once the nut 104 is tightened and the locking end 103 is engaged with the securing means 94, the bolt 100 remains fixed in place relative to the first connection segment 80 and the second connection segment 90. The securing means 94 depicted in FIG. 6 is one embodiment of a securing means and embodiments of different shapes or sizes would perform similarly.

Figure 18:
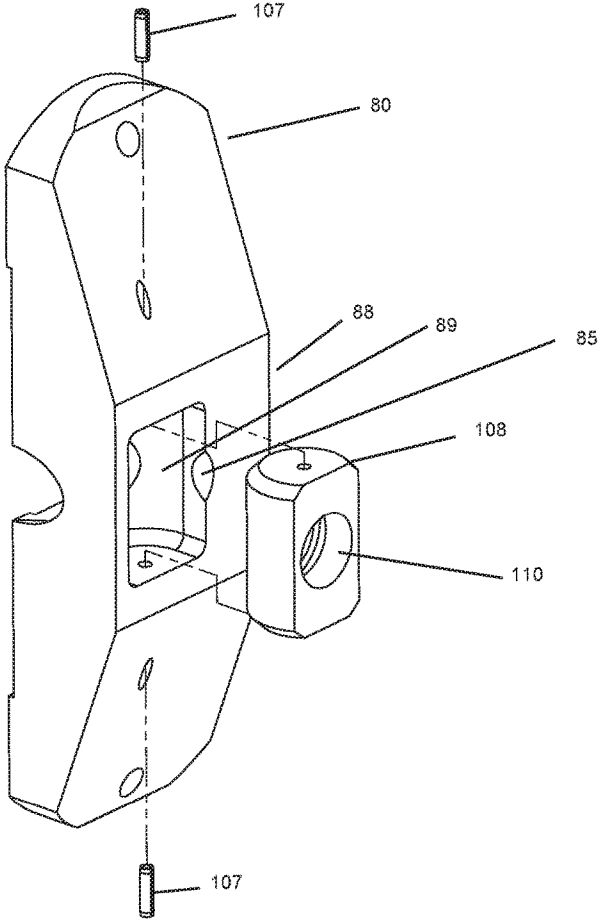
FIG. 18 is an exploded isometric view of the first connection segment and the rotatable joint of FIG. 6.
Figure 19:
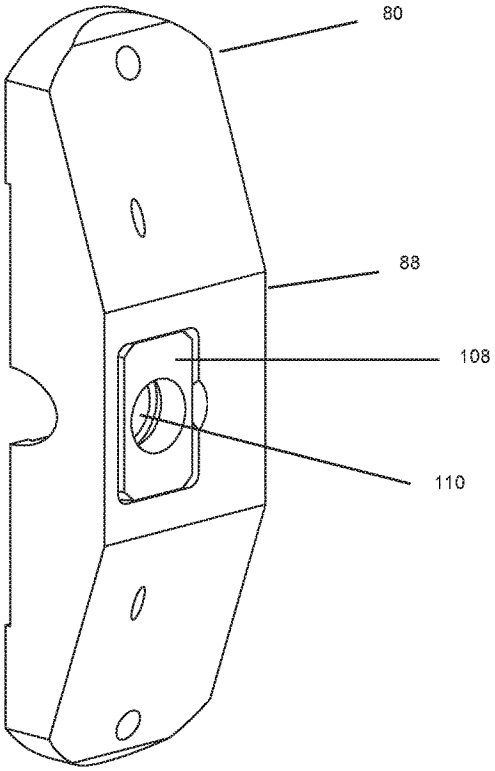
FIG. 19 is an isometric view of the first connection segment 80 and the rotatable joint 108 of FIG. 6.
Figure 20:
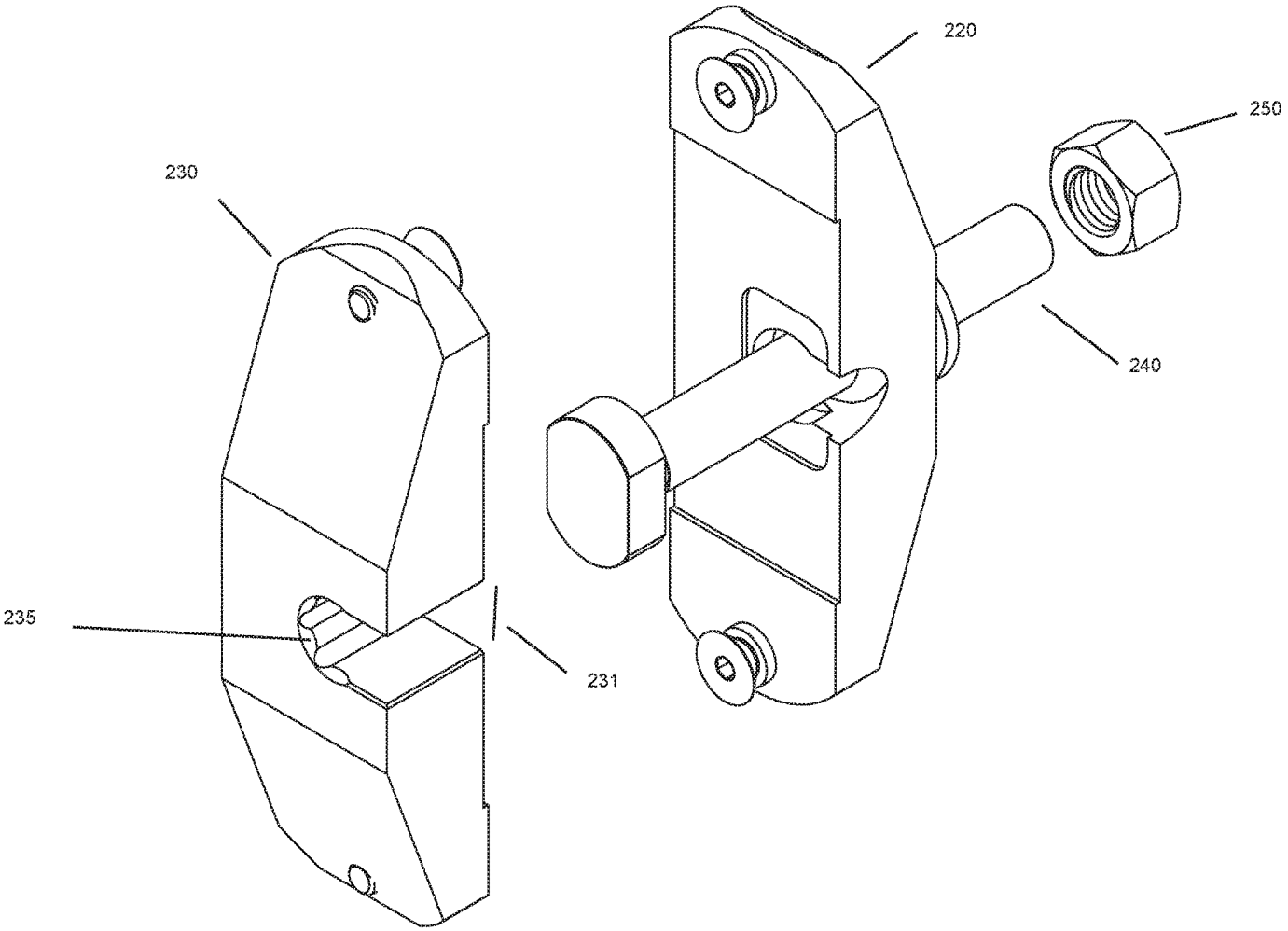
FIG. 20 is an isometric view of a further embodiment of the connection apparatus depicting a first connection segment, second connection segment, bolt, and nut.
Figure 21:
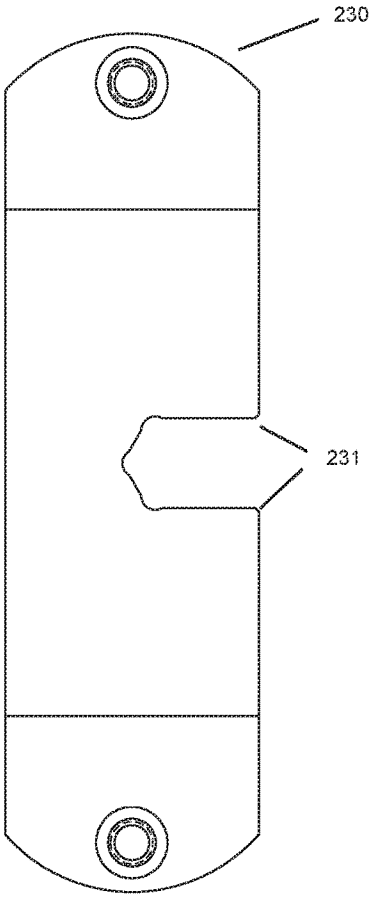
FIG. 21 is a plan view of the second connection segment of the embodiment shown in FIG. 20.
Figure 22:
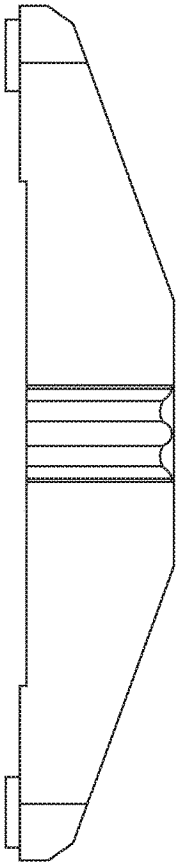
FIG. 22 is a side view of the second connection segment of the embodiment shown in FIG. 21.
Figure 23:
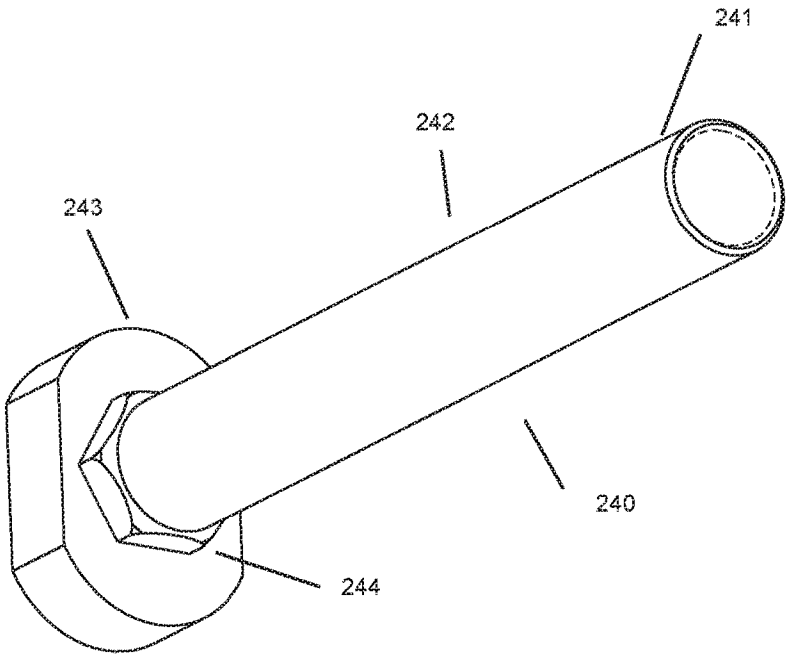
FIG. 23 is an isometric view of the bolt of the embodiment shown in FIG. 20.

The embodiment illustrated in FIG. 6 also comprises a rotatable joint 108. First connection segment 80 comprises an opening 89 on the outer surface 88. The opening 89 is dimensioned to receive the rotatable joint 108 in a close fitting fashion. The rotatable joint 108 comprises pinholes 109 on an upper and a lower surface of the rotatable joint 108. The first connection segment 80 also comprises pinholes 83 which may be aligned with the pinholes 109 of the rotatable joint 108. When the rotatable joint 108 is fitted into opening 89 and the pinholes 83 are aligned with pinholes 109, pins 107 may be inserted through both pinholes in both the rotatable joint 108 and the first connection segment 80 to secure the rotatable joint 108 to the first connection segment 80. When secured, the rotatable joint 108 is only permitted to rotate about pins 107 but is otherwise restricted from movement relative to the first connection segment 80. FIGS. 18 and 19 are two additional perspective views of first connection segment 80 and rotatable joint 108. In FIG. 18, the outer surface 88 and opening 89 of first connection segment 80 are shown. A notch 85 may be provided to allow a tool (such as a screwdriver or the like) to lever the rotatable joint 108 out of the opening 89. FIG. 19 illustrates how the rotatable joint 108 fits into opening 89.

The rotatable joint 108 comprises a borehole 110 which is dimensioned to receive the threaded end 101 of bolt 100. When the bolt 100 is in the borehole 110, the bolt 100 is restricted to axial movement within the borehole 110.

Washers 106 may be provided to prevent damage to the surface of the first connection segment 80 when the nut 104 is tightened on the bolt 100. Moreover, washers 106 are also used to distribute the clamping force of the nut across the rotatable joint 108. The washers 106 also acts as a bearing surface for the nut to minimize binding when the nut 104 is being tightened to bolt 100.

Retainer ring 105 may be provided to prevent the nut 104 from being completely unthreaded from the bolt 100. The retainer ring 105 is fixed to the bolt 100 after the nut 104 has been threaded. The retainer ring 105 prevents the nut from being removed from the bolt unless the retainer ring 105 is first removed.

Figure 7:
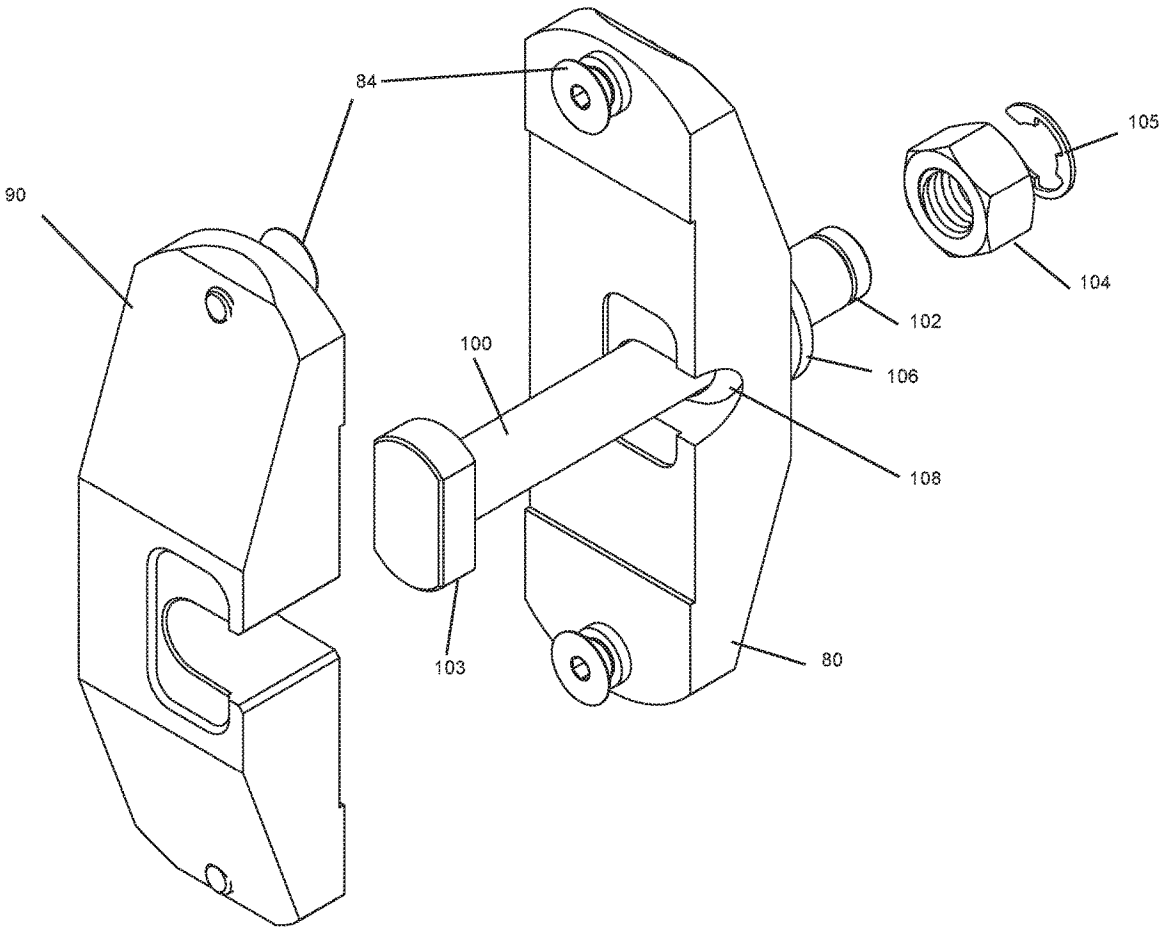
FIG. 7 is an isometric view of the embodiment in FIG. 6 showing the bolt extending through the first connection segment.
Figure 8:
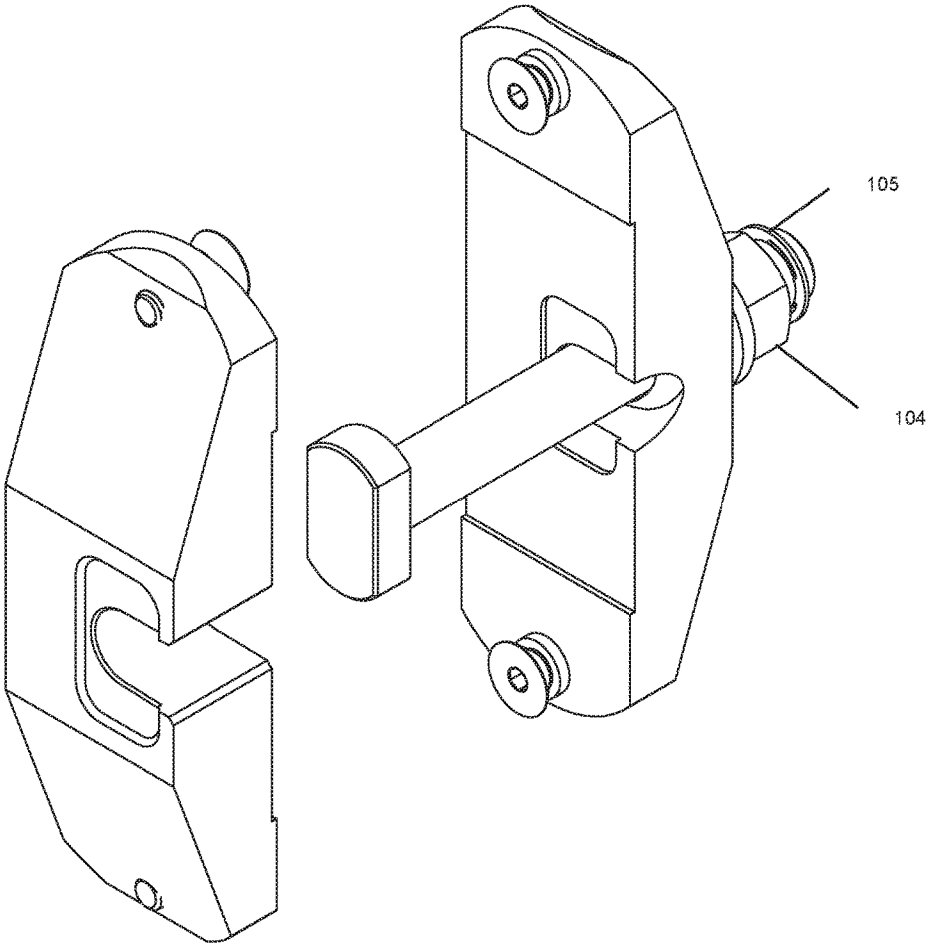
FIG. 8 is a further isometric view of the embodiment in FIG. 7 showing the nut threaded on the bolt, and the retainer ring on the end of the bolt.
Figure 9:
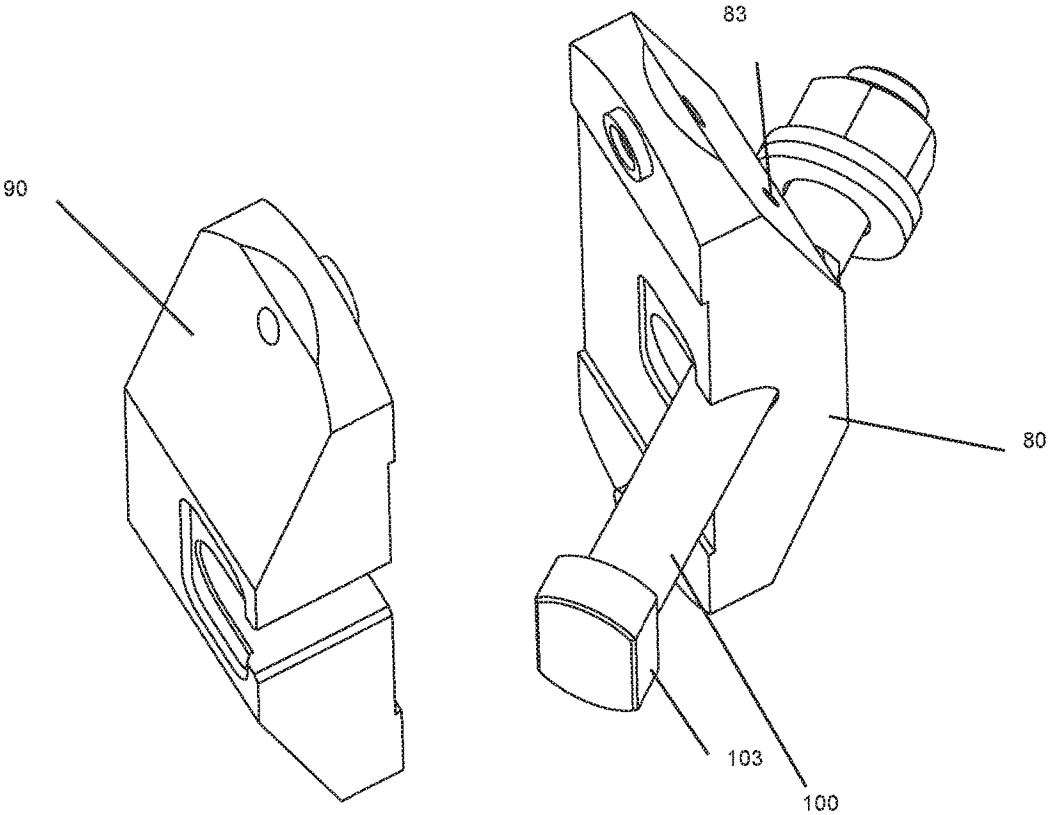
FIG. 9 is a further isometric view of the embodiment in FIG. 8 showing the bolt extending through the first connection segment and the bolt pivoted on an angle from Axis A.

FIGS. 7-12 are further isometric views of the embodiment in FIG. 6. FIGS. 7-9 illustrate how the bolt 100 is secured to first connection segment 108. In FIG. 7, rotatable joint 108 is received in opening 89 of first connection segment 80. The borehole 110 of the rotatable joint 108 is aligned with the borehole 81 of first connection segment 80. Pins 107 rotatably fix the rotatable joint 108 to the first connection segment 80 (not shown). Bolt 100 is received through both borehole 81 of the first connection segment 80 and the borehole 110 of the rotatable joint. In this drawing, washers 106 are slidably fitted to the threaded end 102 of bolt 100.

In FIG. 8, the nut 104 is threaded to the threaded end 101 of bolt 100. The retainer ring 105 has an opening on one side which allows it to be snap-fit to the end of bolt 100. The retainer ring 105 comprises teeth which forms an inner circumference. The inner circumference of the retainer ring is somewhat less than the circumference of the shaft 102 of bolt 100. Bolt 100 comprises a ridge 112. The retainer ring 105 is somewhat flexible. When the opening of the retainer ring 105 is placed adjacent to the ridge 112 of bolt 100, force may be applied to snap-fit the retainer ring 105 to bolt 100.

The retainer ring 105 prevents the nut from being separated from the assembly when it is unthreaded from the threaded portion of bolt 100. Other means for preventing the nut from being separated may also be provided.

FIG. 9 illustrates how bolt 100 may swivel while it is captured in first connection segment 80.

Figure 10:
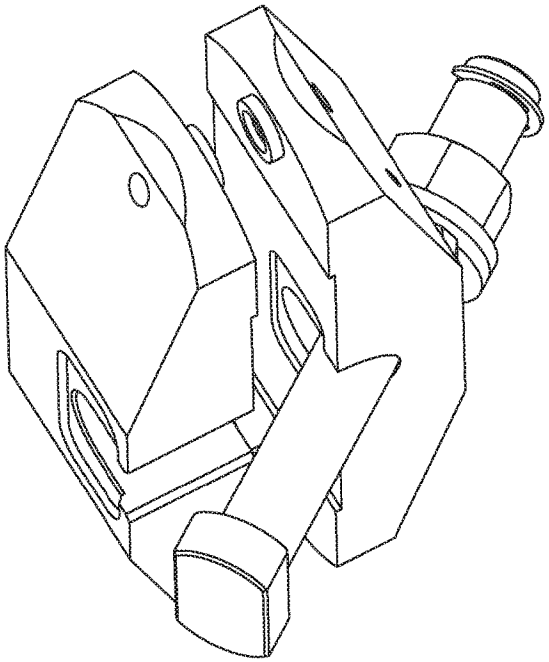
FIG. 10 is a further isometric view of the embodiment in FIG. 9 showing the first connection segment and second connection segment in close proximity.
Figure 11:
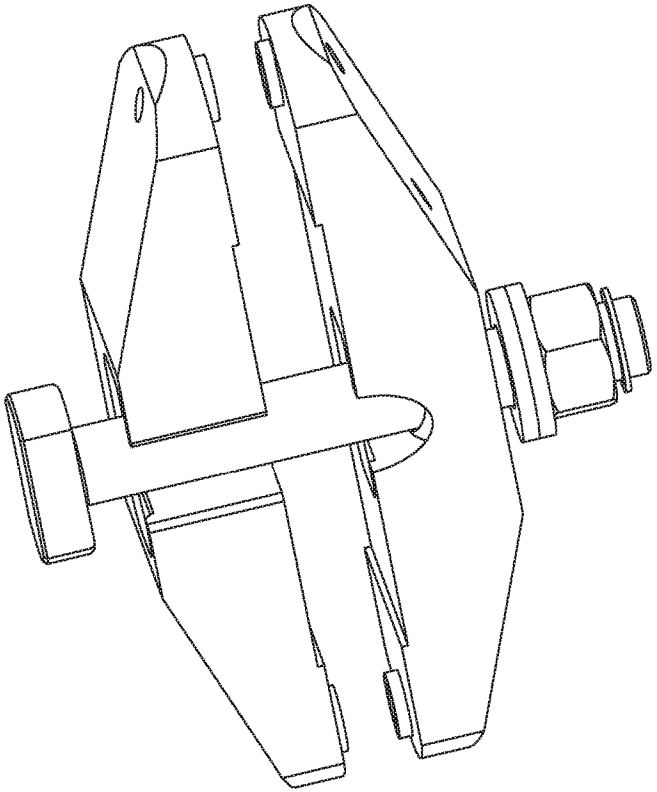
FIG. 11 is a further isometric view of the embodiment in FIG. 10 showing the bolt positioned parallel to Axis A and the locking end of the bolt being spaced from the outer surface of the second connection segment.
Figure 12:
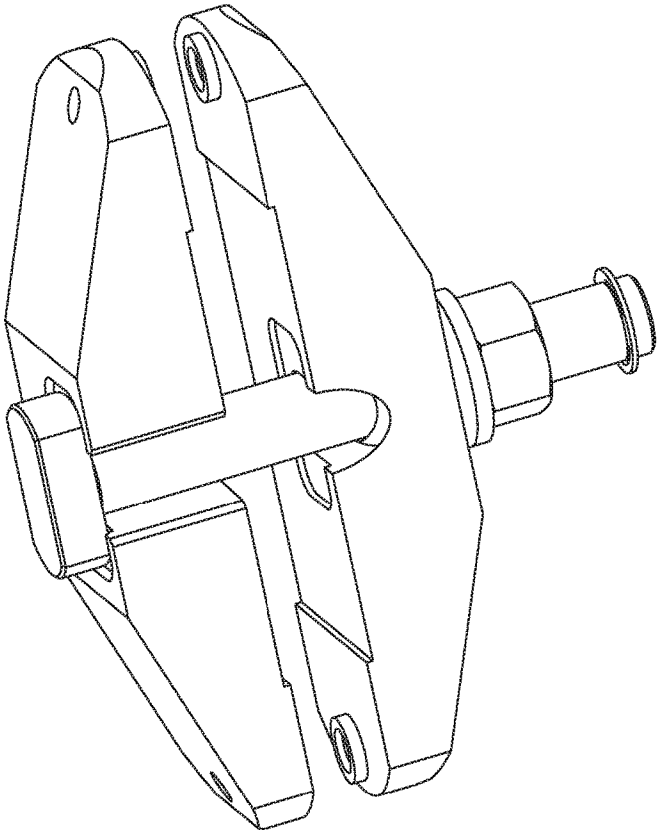
FIG. 12 is a further isometric view of the embodiment in FIG. 11 showing the locking end of the bolt being engaged with the securing means of the second connection segment.

FIGS. 10-12 illustrate how the various parts of the embodiment shown in FIG. 6 are assembled. When a first connection segment 80 and second connection segment 90 are brought together for assembly (FIG. 10), bolt 100 may be pivoted away from the longitudinal Axis A (shown in FIG. 6). Bolt 100 is able to pivot due to the dimensions of borehole 81, which is preferably pie-shaped to allow one end of the borehole 81 to act as a pivot point.

Once the first connection segment 80 and second connection segment 90 are in close proximity, bolt 100 may swivel towards and be parallel to longitudinal Axis A (see FIG. 11). Once the bolt 100 is parallel to longitudinal Axis A, nut 104 may be tightened onto bolt 100 such that the locking end 103 of bolt 100 engages the securing means 94 of second connection segment 90 (see FIG. 12).

FIGS. 13-17 illustrate how the embodiment shown in FIG. 6 is used to interconnect a pair of truss sections 130.

Figure 13:
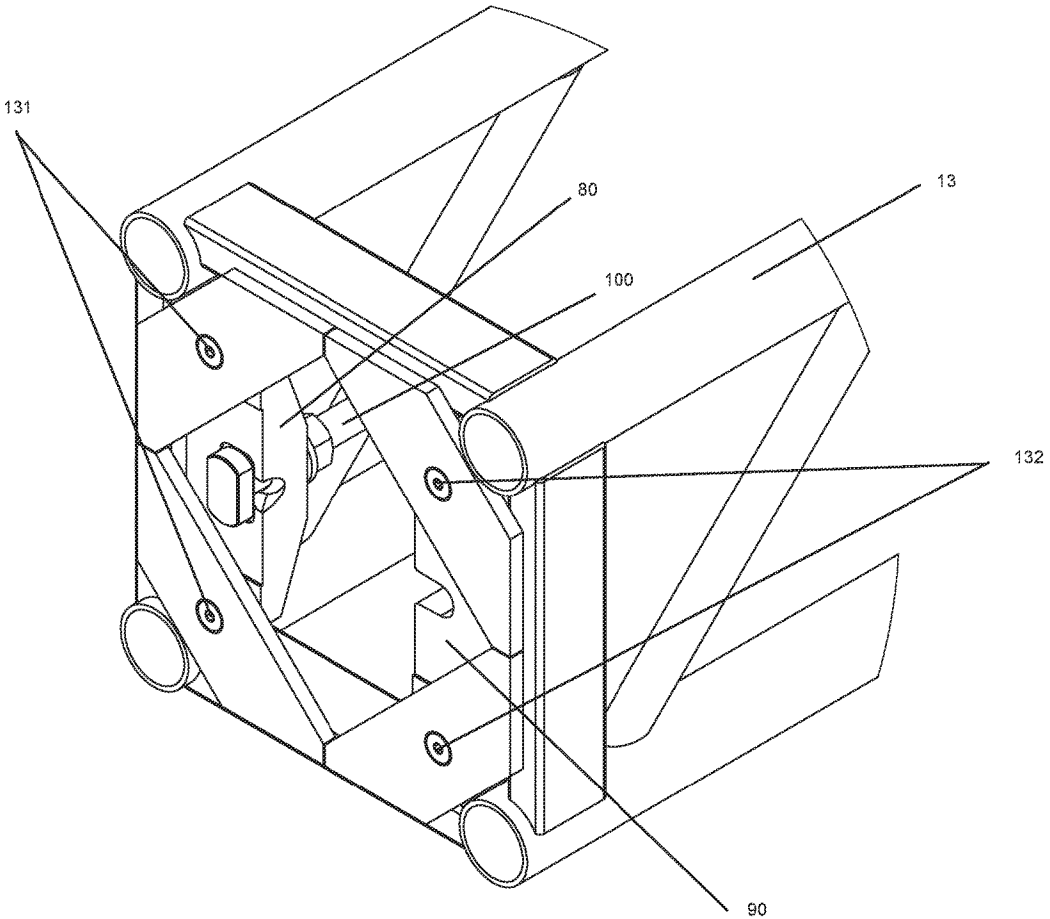
FIG. 13 is an isometric view of a first connection segment and a second connection segment of FIG. 6 attached to a truss section.

FIG. 13 illustrates a first end of a truss section 130 which is provided with a first connection segment 80 and a second connection segment 90. In this embodiment, truss section 130 is provided with four assembly attachment holes 131 and 132 for receiving bolts 84. A pair of assembly attachment holes are provided for each connection segment. To attach a first connection segment, the truss attachment holes 82 are aligned with the assembly attachment holes 131 and bolts 84 are passed through both truss attachment holes 82 and assembly attachment holes 131. The second connection segment is attached in the same way by passing bolts 84 through assembly attachment holes 132 and truss attachment holes 92. Other means may be used to attach the connection segments to a truss section 130. In another embodiment, connection segments may be integral with the truss section 130, or may be built into the body of truss section 130.

When the assembly is not in use, the nut 104 may be tightened to bolt 100 such that the bolt 100 is restricted from movement, such as shown in FIG. 13. This prevents the bolt 100 from movement while the truss segment is being moved or transported. The bolt 100 and nut 104 may be transported with the truss section 130 so that there is no separate requirement to transport or locate parts to assemble the truss segments once they have been moved or transported. In this way, all the equipment needed to assemble the truss is transported with the truss segments.

Figure 14:
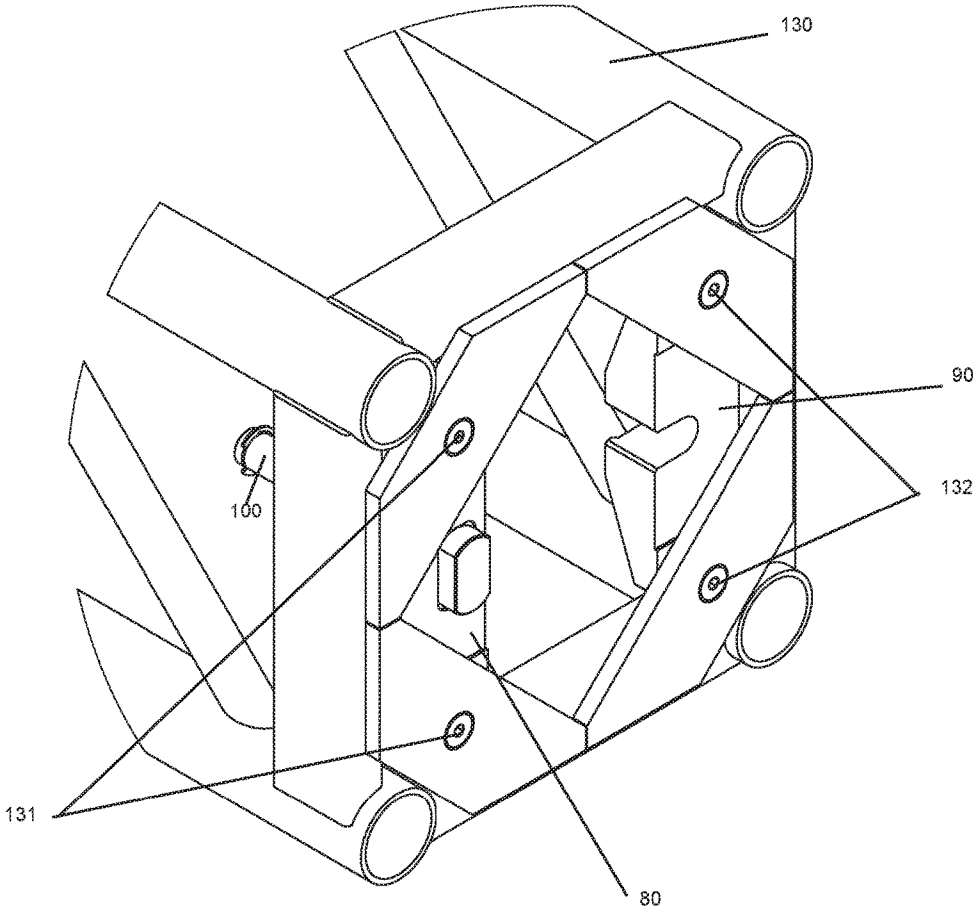
FIG. 14 is an isometric view of first connection segment and a second connection segment of FIG. 6 attached to another truss section.

FIG. 14 illustrates a second end of a truss section 130 which is provided with a first connection segment 80 and a second connection segment 90. To assemble a truss structure, truss section 130 are attached end to end. A first connection segment 80 of a first truss section 130 is aligned with a second connection segment 90 of a second truss section 130. Similarly, a second connection segment 90 of a first truss section 130 is aligned with a first connection segment 80 of a second truss section 130.

Figure 15:
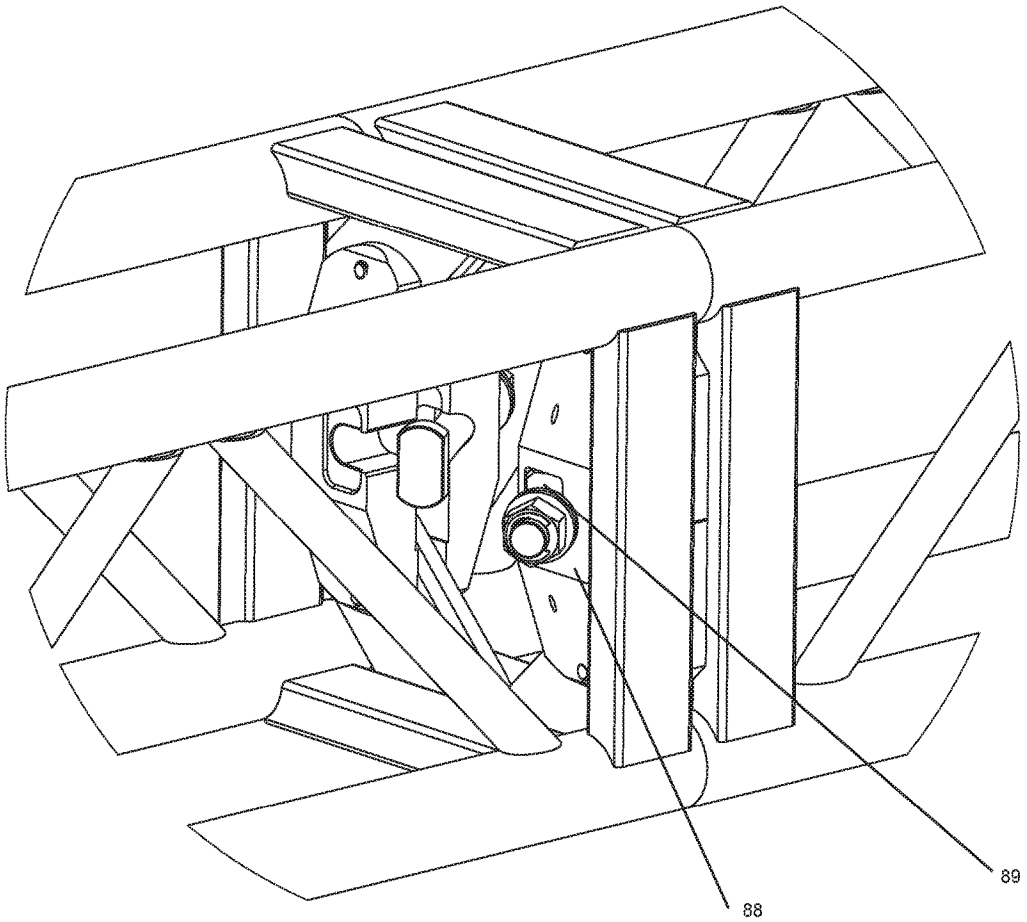
FIG. 15 is an isometric view of the truss section of FIG. 13 and the truss section of FIG. 14 in close proximity, and the bolts positioned on an angle from Axis A.
Figure 16:
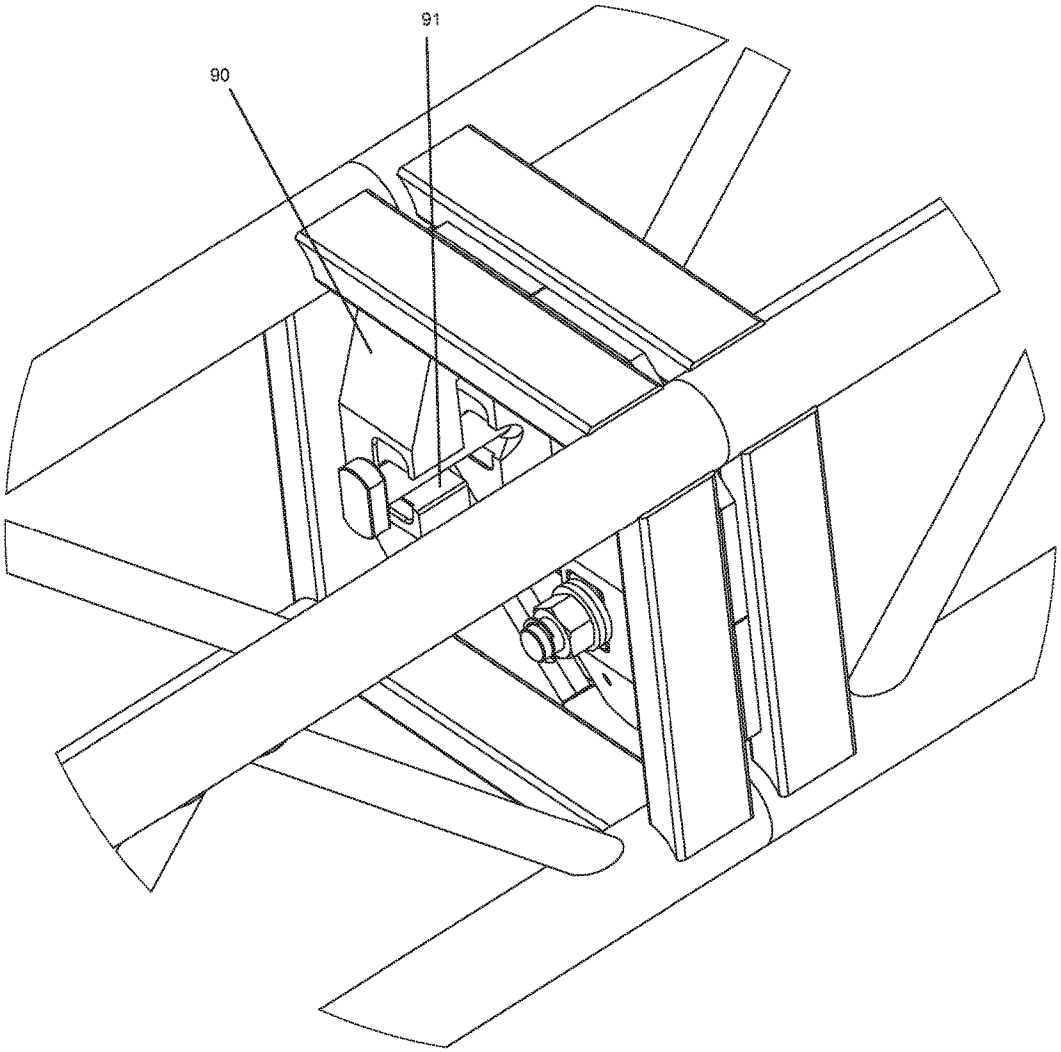
FIG. 16 is a further isometric view of the truss structure in FIG. 15 showing the bolts positioned parallel with Axis A and the locking end of the bolt spaced apart from the outer surface of the second connection segment.
Figure 17:
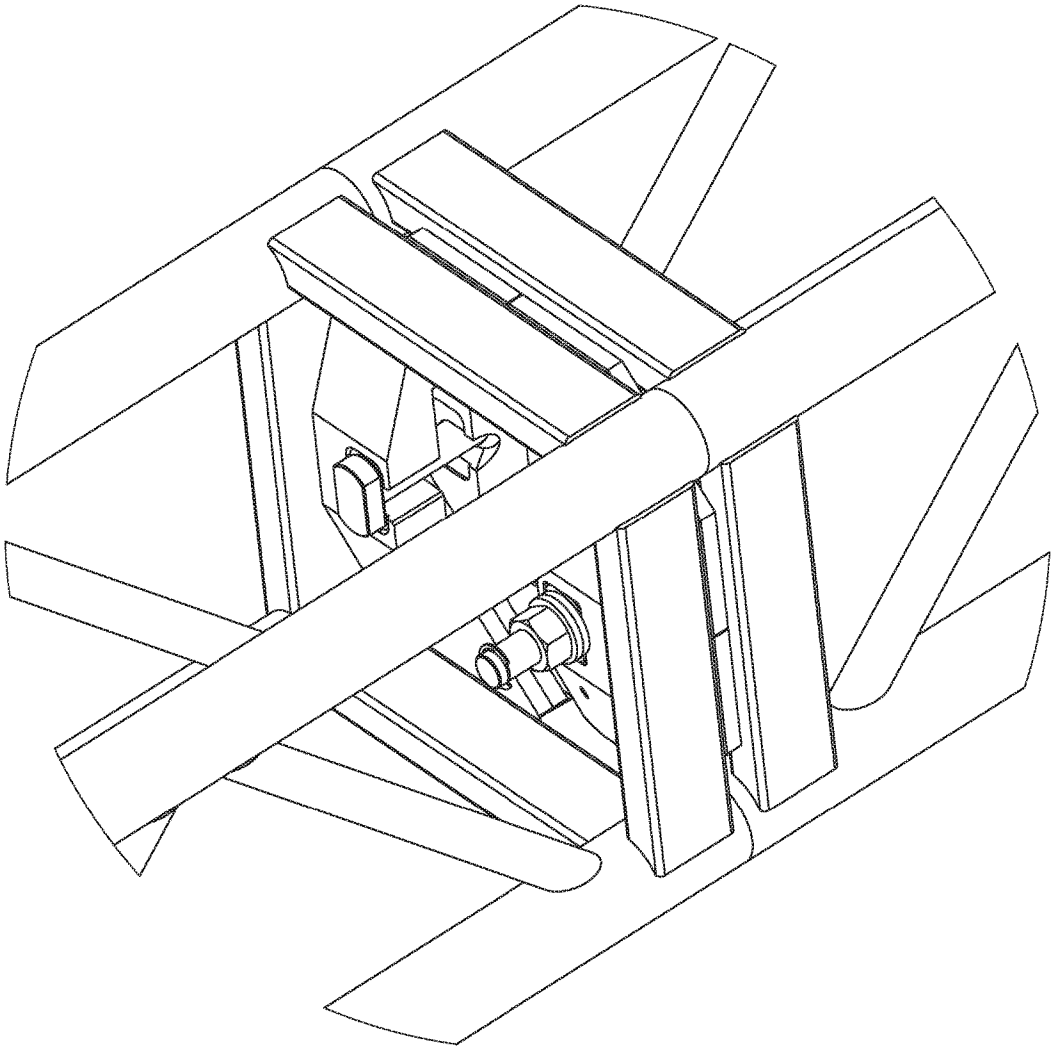
FIG. 17 is a further isometric view of the truss structure of FIG. 16 showing the locking end of the bolt engaged with the securing means on the outer surface of the second connection segment.

FIG. 15 illustrates a pair of truss sections 130 which are each provided with the connection segments illustrated in FIG. 6. In this embodiment, two pairs of the assembly are provided. Before the truss segments are brought together, nut 104 is sufficiently loosened to allow bolt 100 to swivel to a position diagonal to the length of the truss segment (shown in FIG. 15) and away from opening 91 of the second connection segment 90. The adjacent truss sections 130 are positioned end to end and the connection segments of a first truss section 130 are aligned with their counterpart connection segments on a second truss section 130. In FIG. 16, bolts 100 are swivelled into opening 91 of the respective second connection segments 90 such that bolts 100 are aligned through opening 91 of second connection segment 90 and borehole 81 of first connection segment 80. Once the bolt 100 is aligned, nut 104 is tightened to secure locking end 103 of bolt 100 to the securing means 94 of the second connection segment 90 (see FIG. 17). The edges of the locking end 103 engage the walls of the oblong depression of the securing means 94 to prevent the bolt from rotating, particularly as the nut 104 is being tightened to the bolt 100.

FIGS. 20-23 illustrate a further embodiment of the present invention, comprising a first connection segment 220, a second connection segment 230, a first fastener 240 (for example, a bolt) and a second fastener 250 (for example, a nut).

In this embodiment, second connection segment 230 comprises a hexagonal-shaped indentation 235 on the outer surface along the outer edge of opening 231. The profile of the opening 231 (shown in FIG. 21, a plan view of the second connection segment 230) is also hexagonal-shaped. In this embodiment, bolt 240 comprises a locking end 243, a shaft 242, and a threaded end 241 (threads not shown). The locking end 243 comprises an oblong shaped flange portion. Although depicted as oblong shape, the flange portion may be any suitable shape for ease of handling the bolt 240 provided that it is wider than the diameter of the openings in both the first and second connection segments.

The bolt 240 further comprises a hexagonal-shaped projection 244 (illustrated in FIG. 23) on the underside of the oblong shaped flange portion. In this embodiment, the hexagonal-shaped projection 244 of the bolt 240 mates with the hexagonal-shaped indentation 235 of the second connection segment 230. When the edges of the projections 244 engages the edges of indentations 235, the bolt 240 is prevented from rotational movement relative to the second connection segment 230.

Although embodiments of the present invention have been described above and are illustrated in the accompanying drawings in order to be more clearly understood, the above description is made by way of example and is not meant to limit the scope of the present invention. It is contemplated that various modifications apparent to one of ordinary skill in the art could be made without departing from the scope of the invention which is to be determined by the following claims.

The invention claimed is:

1. A connection apparatus comprising:

an elongated first fastener comprising:

a threaded end;

a locking end opposite the threaded end; and a shaft between the locking end and the threaded end;

a second fastener adapted to receive the threaded end of the first fastener;

a first connection segment, the first connection segment comprising an aperture dimensioned to receive therethrough the threaded end and the shaft of the first fastener, the aperture is further adapted to allow the first fastener to pivot radially within the aperture between a first position and a second position, whereby the first position is at an angle relative to the second position;

a second connection segment, the second connection segment comprising a body, comprising a side opening adapted to receive the shaft of the first fastener and further adapted to allow the first fastener to pivot between the first position and the second position;

an outer surface comprising a securing means adapted to fixably secure the locking end of the first fastener;

whereby when the first fastener extends through the aperture of the first connection segment in the first position and the first and second connection segments are aligned and brought in proximity, the first fastener is aligned with the side opening of the second connection segment and outside the body of the second connection segment;

whereby when the first fastener is in the second position inside the side opening, the first fastener is inside the body of the second connection segment; and whereby when the second fastener is tightened to the threaded end of the first fastener and the locking end of the first fastener engages the outer surface of the body of the second connection segment, the first fastener is prevented from rotational or axial movement and the first and second connection segments are fixed relative to each other.

2. The connection apparatus of claim 1, wherein the aperture of the first connection segment further comprises a rotatable joint which is rotatably fixed to the first connection segment, the rotatable joint comprising an aperture for receiving the first fastener, wherein when the first fastener is received through the aperture of the rotatable joint, the first fastener is pivotable radially between the first position and the second position.

3. The connection apparatus of claim 1, wherein the outer surface of the second connection segment comprises a securing means, whereby when the second fastener is threaded and tightened to the threaded end of the first fastener and the locking end of the first fastener engages the securing means, the first fastener is prevented from rotational or axial movement and the first and second connection segments are fixed relative to each other.

4. The connection apparatus of claim 3 wherein the securing means comprises a cavity substantially corresponding in shape to the locking end of the first fastener.

5. The connection apparatus of claim 4 wherein the first fastener is a bolt and the second fastener is a nut.

6. The connection apparatus of claim 4 wherein the threaded end of the first connection segment further comprises a stopper, wherein the stopper is wider than the inner diameter of the second fastener whereby the second fastener is prevented from removal from the first fastener.

7. The connection apparatus of claim 4, wherein the connection apparatus interconnects a first object and a second object, wherein first connection segment is integral with the first object, and the second connection segment is integral with the second object.

8. The connection apparatus of claim 4, wherein the locking end of the first fastener is dimensioned such that it is prevented from passing through the aperture of the first connection segment.

9. The connection apparatus of claim 1 wherein the first fastener is a bolt and the second fastener is a nut.

10. The connection apparatus of claim 1 wherein the threaded end of the first connection segment further comprises a stopper, wherein the stopper is wider than the inner diameter of the second fastener whereby the second fastener is prevented from removal from the first fastener.

11. The connection apparatus of claim 10 wherein the stopper is a retainer ring and wherein the threaded end of the first fastener further comprises a channel for receiving the retainer ring.

12. The connection apparatus of claim 1, wherein the locking end of the first fastener is dimensioned such that it is prevented from passing through the aperture of the first connection segment.

13. The connection apparatus of claim 1, wherein the connection apparatus interconnects a first object and a second object, wherein first connection segment is integral with the first object, and the second connection segment is integral with the second object.

14. The connection apparatus of claim 13, wherein the first object is a first truss section, and the second object is a second truss section.

15. A truss section, comprising:

at least one first connection segment for connection to a corresponding second connection segment on a second truss section, each of the at least one first connection segments comprising an aperture dimensioned to receive therethrough the threaded end and the shaft of a first fastener, the aperture is further adapted to allow the first fastener to pivot radially within the aperture between a first position and a second position, whereby the first position is at an angle relative to the second position;

wherein the corresponding second connection segment comprises a body, comprising a side opening adapted to receive the shaft of the first fastener and further adapted to allow the first fastener to pivot between the first position and the second position, and an outer surface comprising a securing means adapted to fixably secure the locking end of the first fastener;

whereby when the first fastener extends through the aperture of the first connection segment in the first position and the first and second connection segments are aligned and brought in proximity, the first fastener is aligned with the side opening of the second connection segment and outside the body of the second connection segment;

whereby when the first fastener is in the second position inside the side opening, the first fastener is inside the body of the second connection segment; and whereby when the second fastener is tightened to the threaded end of the first fastener and the locking end of the first fastener engages the outer surface of the body of the second connection segment, the first fastener is prevented from rotational or axial movement and the first and second connection segments are fixed relative to each other.

16. The truss section of claim 15, wherein the aperture of the first connection segment further comprises a rotatable joint which is rotatably fixed to the first connection segment, the rotatable joint comprising an aperture for receiving the first fastener, wherein when the first fastener is received through the aperture of the rotatable joint, the first fastener is pivotable radially between the first position and the second position.

17. The truss section of claim 15, wherein the outer surface of the second connection segment comprises a securing means, whereby when the second fastener is threaded and tightened to the threaded end of the first fastener and the locking end of the first fastener engages the securing means, the first fastener is prevented from rotational or axial movement and the first and second connection segments are fixed relative to each other.

18. The truss section of claim 17 wherein the securing means comprises a cavity substantially corresponding in shape to the locking end of the first fastener.

19. The truss section of claim 15, wherein the locking end of the first fastener is dimensioned such that it is prevented from passing through the aperture of the first connection segment.

* * * * *